United States Patent [19]

Gordon

[11] Patent Number: 4,666,041

[45] Date of Patent: May 19, 1987

[54] INFLATABLE ELEVATOR FOR COVERING AND BANDING OF FIBRE DRUMS

[75] Inventor: Gerald A. Gordon, Skokie, Ill.

[73] Assignee: Continental Fibre Drum, Inc., Stamford, Conn.

[21] Appl. No.: 802,241

[22] Filed: Nov. 27, 1985

[51] Int. Cl.[4] ..... B65D 8/06

[52] U.S. Cl. ..... 206/522; 206/567; 220/1 T; 220/1 S; 220/409; 220/410

[58] Field of Search ..... 206/522, 567; 220/1 T, 220/1 S, 409, 410, 411

[56] References Cited

U.S. PATENT DOCUMENTS

| | | | |
|---|---|---|---|
| 1,140,414 | 5/1915 | Steel | 220/410 |
| 1,158,783 | 11/1915 | Brown | 220/403 |
| 1,163,389 | 12/1915 | Brown | 220/1 T |
| 1,549,618 | 8/1925 | Skoda | 220/426 |
| 1,752,101 | 3/1930 | Meutsch | 248/354.1 |
| 2,146,381 | 2/1939 | Rheem | 220/411 |
| 3,082,901 | 3/1963 | Nakagawa | 220/1 T |
| 3,199,689 | 8/1965 | Feldkamp | 206/522 |
| 3,967,360 | 7/1976 | Nolte | 29/252 |
| 4,286,723 | 9/1981 | Schutz | 220/410 |
| 4,418,514 | 12/1983 | Spann | 53/436 |

FOREIGN PATENT DOCUMENTS

| | | | |
|---|---|---|---|
| 2385606 | 12/1978 | France | 206/522 |

*Primary Examiner*—William Price
*Assistant Examiner*—Brenda J. Ehrhardt
*Attorney, Agent, or Firm*—Charles E. Brown

[57] ABSTRACT

This relates to a telescoped twin drum arrangement for disposal of hazardous materials. Most specifically there is provided a steel first and outer drum and a fibre second and inner drum. By placing the material which is to be disposed within the fibre drum and then the fibre drum within the steel drum, all government regulations with respect to the shipment of hazardous material are met. On the other hand, at the point of disposal, the fibre drum may be separately disposed of together with the hazardous material retained therein while the still clean steel drum and its cover components may be returned to the place of origin for refilling with anther fibre drum. In order to facilitate the closing of the fibre drum, there is placed in the bottom of the steel drum beneath the fibre drum an elevator or inflated support in the form of a pillow. After the fibre drum is filled and its cover placed thereon together with the associated locking band, the support is deflated so as to permit the fibre drum to be fully seated within the steel drum, after which the steel drum may be closed. If desired, the support may be reinflatable so as to lift the fibre drum partially out of the steel drum at the disposal destination so that the fibre drum may be readily gripped and lifted from the steel drum.

12 Claims, 6 Drawing Figures

10
12
16
18
20
22
24
26
28
29
30
32
34
36
38
40

INFLATABLE ELEVATOR FOR COVERING AND BANDING OF FIBRE DRUMS

This invention relates in general to new and useful improvements in the use of fibre drums for the packaging of materials, and more particularly to the utilization of a fibre drum for the packaging of hazardous waste to be shipped to a disposal location.

The disposal of industrial hazardous waste by incineration is a practice that is becoming more widely used even though it may be somewhat more expensive than such alternative means as land filling.

The use of fibre drums for the packaging of waste for shipment to the incinerator and subsequent incineration is a practice that is encouraged by incinerator operators because the fibre drums burn up with the waste, leaving little or no residue to be disposed of as ash by landfilling.

However, governmental hazardous material transportation regulations require that at least certain of these wastes, e.g. corrosive liquids or flammable liquids with flash points below 73° F., may not be shipped in an economical type of fibre drum, but require either a much more expensive composite fibre drum or a steel drum which must be decontaminated after use. Both of these alternatives add significant cost and inconvenience.

It has been proposed by others that the hazardous waste may be packaged in an inexpensive type of fibre drum, after which the filled and closed fibre drum is packed in a steel drum for shipment to the incinerator. At the incinerator, the fibre drum is removed from the steel drum and incinerated while the clean, empty steel drum is returned to the source for another load.

This proposal has the problem of being able to close the toggle action locking band which holds the cover onto the fibre drum after it is filled, when the fibre drum substantially fills the steel drum. Another problem is grasping the fibre drum and the removal thereof from the steel drum at the incinerator.

In accordance with this invention, there is provided a simple air-filled plastic pillow which functions as an inflatable support. The plastic pillow type support or elevator is placed within the steel drum, the empty fibre drum is seated in the steel drum on the inflated support, the fibre drum is then filled with the hazardous material and the cover is applied and locked in place with its toggle action locking band, after which the support or elevator is deflated so as to permit the fibre drum with the hazardous waste therein to be lowered fully within the steel drum. Thereafter the steel drum may be readily closed in the conventional manner.

With the above and other objects in view that will hereinafter appear, the nature of the invention will be more clearly understood by reference to the following detailed description, the appended claims, and the several views illustrated in the accompanying drawings.

Figures 3, 4, 5, 6:
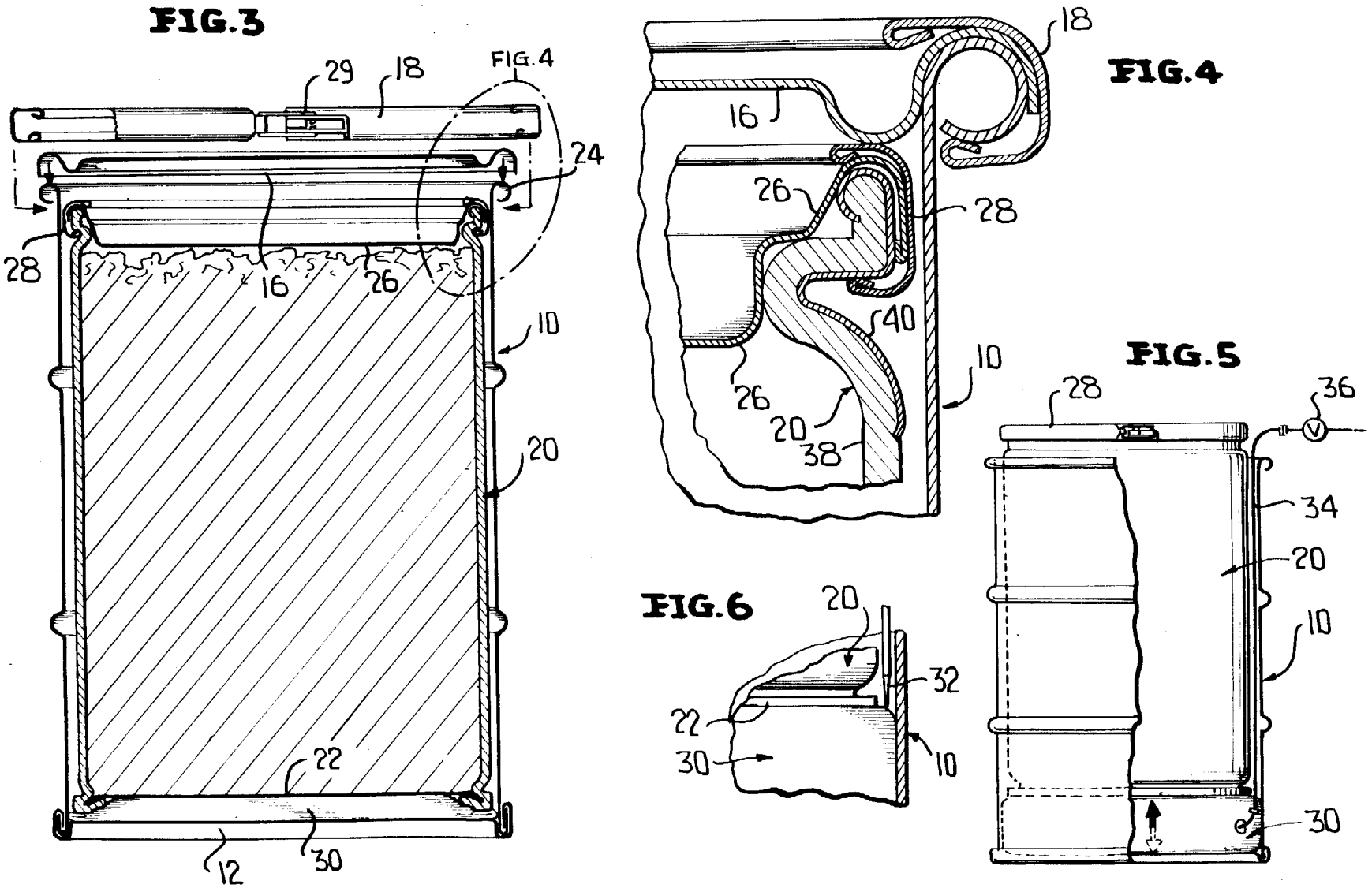
FIG. 3 is another schematic vertical sectional view similar to FIG. 2 but shows the closed fibre drum being fully seated within the steel drum and the support being deflated, there also being shown the cover and locking band for the steel drum.
FIG. 4 is an enlarged fragmentary sectional view of the encircled portion of FIG. 3 designated FIG. 4 and shows the relationship of the closed steel drum to the closed fibre drum.
FIG. 5 is a schematic elevational view with parts broken away and shown in section of the two drum assembly showing the manner in which the support may be deflated or reinflated.
FIG. 6 is an enlarged fragmentary sectional view through lower portions of the drum and shows the manner in which the inflated support may be pierced to effect deflation thereof.

Referring now to the drawings in detail, it will be seen that there is illustrated a two drum assembly in accordance with the invention. The two drums include a first drum generally identified by the numeral 10. The first drum 10 is a relatively strong and relatively expensive drum and normally will be a steel drum. The steel drum will have the lower end thereof closed by a closure member 12. The steel drum 10 will have an open top 14 which is normally closed by a steel closure member 16 which is secured in place by a locking band 18 as is best shown in FIG. 3.

A second drum, generally identified by the numeral 20, is intended to be telescoped within the steel drum 10. The second drum 20 is a fibre drum having a bottom wall 22 closing the lower end thereof. The fibre drum 20, like the steel drum 10, has an open top 24. The open top 24 is closed by a cover 26 and a locking band 28 which has a toggle action lever 29 which, when released, projects radially outwardly beyond the steel drum 10.

In accordance with this invention there is provided an inflated support, generally identified by the numeral 30. The support 30 may be in the form of an inexpensive plastic pillow which may be considered an elevator.

Figure 2:
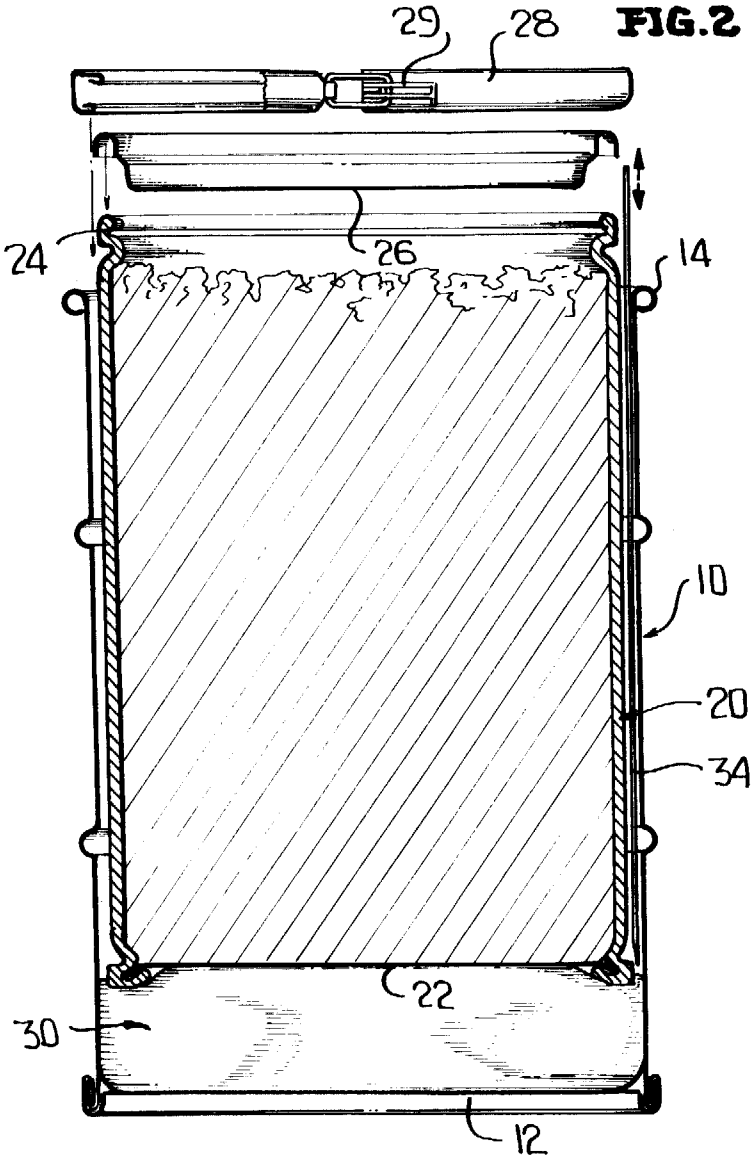
FIG. 2 is a schematic vertical sectional view showing the fibre drum seated on the inflated support with the fibre drum being in its filled state and the cover and locking band for the fibre drum being in position to close the fibre drum.
Figure 1:
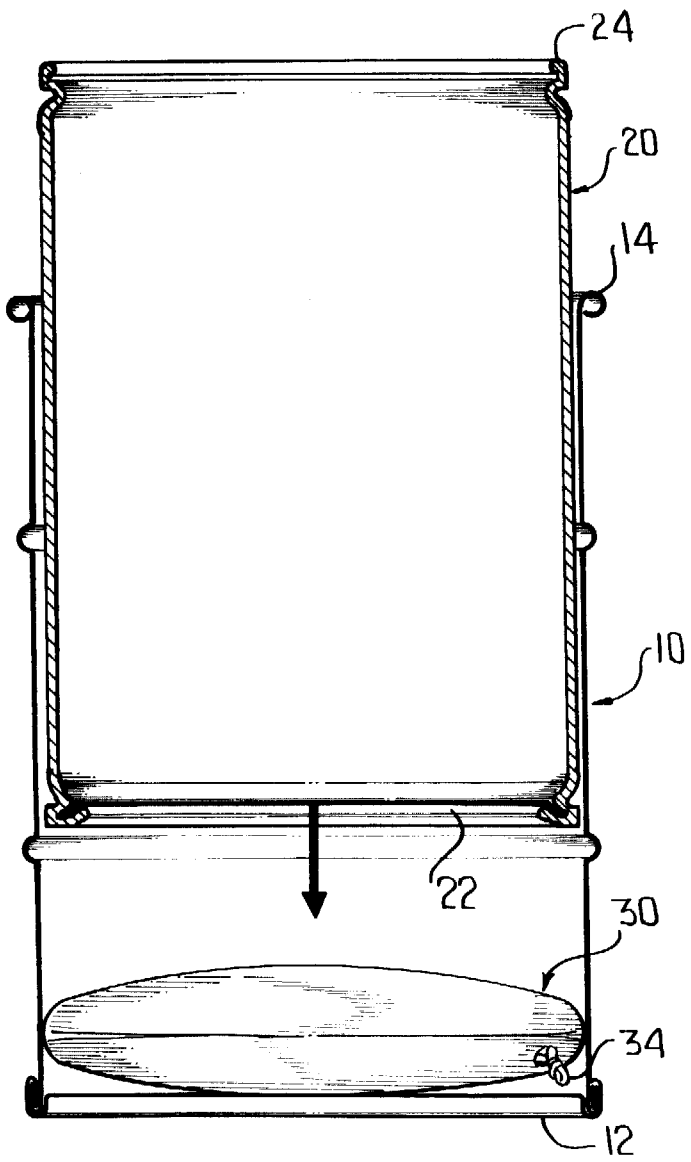
FIG. 1 is a schematic sectional view taken through a steel drum having seated in the bottom thereof an inflated, deflatable support and shows a fibre drum being telescoped within the steel drum to be seated on the support.

As is best shown in FIG. 1, prior to filling of the fibre drum 20, the inflated pillow 30 is disposed in the bottom of the first drum 10, after which the empty second drum 20 is telescoped within the first drum 10 and seated on the inflated support 30. This is shown in FIGS. 1 and 2. At this time the open end 24 of the second drum 20 is elevated with respect to the first drum 10 such that the upper portion of the second drum 20 projects out of the open end 14 of the first drum 10 sufficiently for the closure 26 and the locking band 28 to be applied after filling. This is clearly shown in FIG. 2.

It is to be understood that the second drum 20 is filled while it is telescoped within, but projecting out of the first drum 10. Thereafter, the second drum 20 is closed by way of the closure 26 and the locking band 28.

The sealed second drum 20 may now be lowered fully into the first drum 10 by deflating the support 30. This may be accomplished in several manners. If the pillow or elevator 30 is not to be re-extended or reinflated, then the pillow construction may be relatively cheap and the pillow may be deflated by puncturing the same utilizing a puncturing tool 32 which may be slid down between the inner surface of the first drum 10 and the outer surface of the second drum 20 as is shown in FIG. 6.

On the other hand, when it is desired that the inflated support or pillow 30 be reusable, it may be of a more expensive construction and have leading therefrom a tube 34. The tube 34 will have its upper end closed by a simple valve 36 which, when opened, will normally exhaust the inflated support 30 to the atmosphere.

Once the second drum 20 is fully seated within the first drum 10, as is shown in FIG. 3, the cover 16 may be applied to the first drum 10 and then secured in place by the locking band 18. The twin drum assembly is now ready for shipment.

It is understood that when the twin drum assembly reaches a disposal place, such as an incinerator, the steel first drum 10 is opened, after which the second drum 20 is removed therefrom in a suitable manner. If the inflated support 30 is reinflatable, such as shown in FIG. 5, then air under pressure is directed through the valve 36, which is open, into the flexible support 30 to reinflate the same. The support 30 now functions as an elevator to elevate the upper portion of the second drum 20 out of the open top of the first drum 10. This will permit the second drum to be suitably gripped for removal from the first drum 10 and disposal.

It will be seen that since the hazardous product is disposed entirely within the second drum 20, the first drum 10 remains clean and may be reclosed and shipped back to a place of origin for refilling utilizing another fibre drum.

On the other hand, if the second drum is to be incinerated, a majority thereof will burn leaving only a small amount of ash together with the metal parts thereof such as the locking band 28 and the like to be handled as waste. At this time it is pointed out that the fibre drum 20, while the body 38 fixed thereof is primarily formed of a burnable paper, may include such metal components as chimes 40 at both end. Further, the closure or cover 26 may be formed of steel.

Although only a preferred embodiment of the invention has been specifically illustrated and described herein, it is to be understood that minor variations may be made in the two drum assembly, such as changes in materials, without departing from the spirit and scope of the invention as defined by the appended claims.

I claim:

1. The combination of a metal first drum having a bottom wall and an open top closed by a removable cover, a second drum seated within said first drum, said second drum having a bottom wall and an open top closed by a removable cover, and a deflated pillow-like support positioned between said bottom walls, said pillow-like support having an inflated height to position said second drum open top above said first drum open top to apply said second drum cover, whereby with said pillow-like support inflated, said second drum may be telescoped with said first drum, seated on said pillow-like support, filled and closed.

2. The combination of claim 1 wherein said second drum is of the type having a peripheral locking band for retaining said second drum cover on said second drum, and the height of said pillow-like support is one wherein said peripheral locking band may be applied while said second drum is within said first drum and seated on said pillow-like support.

3. The combination of claim 2 wherein said second drum is a fibre drum.

4. The combination of claim 1 wherein said second drum is a fibre drum.

5. The combination of claim 1 wherein the cost of said second drum as compared to the cost of said first drum is such that said second drum is disposable while said first drum is economically salvageable.

6. The combination of claim 1 wherein said pillow-like support is punctured and disposable.

7. The combination of claim 1 wherein said pillow-like support has means for reinflating the same.

8. The combination of claim 1 wherein said pillow-like support has means for reinflating the same and is economically salvageable.

9. The combination of claim 1 wherein said first drum is a steel drum and said second drum is a fibre drum.

10. A method of packaging a harmful material, said method comprising the steps of providing a strong first drum, placing an inflated support within said first drum, seating a relatively weak second drum in said first drum on said support with said second drum projecting out of said first drum, filling and closing said second drum, deflating said support to lower and fully seat in said first drum, and closing said first drum.

11. A method according to claim 10 wherein said support is deflated by puncturing.

12. A method according to claim 10 wherein at a point of destination said first drum is opened, said support is reinflated to lift said second drum relative to said first drum to a position wherein a top portion of said second drum is accessible.

* * * * *